US005423145A

United States Patent [19]

Nasset

[11] Patent Number: 5,423,145

[45] Date of Patent: Jun. 13, 1995

[54] RIFLE-BARREL HARMONIC VIBRATION TUNING DEVICE

[76] Inventor: James L. Nasset, 5157 Dumore Dr. SE., Aumsville, Oreg. 97325

[21] Appl. No.: 307,267

[22] Filed: Sep. 16, 1994

[51] Int. Cl.[6] ..... F41C 27/22

[52] U.S. Cl. ..... 42/75.01; 42/97

[58] Field of Search ..... 42/75.01, 75.02, 85, 42/97

[56] References Cited

U.S. PATENT DOCUMENTS

| | | | |
|---|---|---|---|
| 2,140,945 | 12/1938 | Swarz | 42/97 |
| 2,589,912 | 3/1952 | Weld | 42/75.01 |
| 2,610,426 | 9/1952 | Emerson | 42/75.01 |
| 3,060,612 | 10/1962 | Brown et al. | 42/75.01 |
| 3,340,641 | 9/1967 | Recker | 42/75.01 |
| 3,604,136 | 9/1968 | Edwards | 42/97 |
| 4,057,924 | 11/1977 | Joseph | 42/75.01 |
| 4,282,671 | 8/1981 | Wood et al. | 42/75.01 |

*Primary Examiner*—Charles T. Jordan

[57] ABSTRACT

A harmonic vibration tuning device is provided in the forestock of a rifle engaging a cantilevered barrel forward of the rifle action, for the purpose of effecting a change the harmonic vibration frequency of the barrel, that is generated, as a projectile moves through the barrel to the muzzle. This adjustable change in the harmonic vibration frequency of the barrel causing a controllable change in the impact placement of a plurality of fired projectiles. The harmonic vibration tuning device of the preferred embodiment includes a containment assembly that is mounted in a cavity formed in the forestock. The assembly includes a threaded adjustment shaft extending horizontally through the assembly with the shaft being threadedly mated with a reactive contact means. The reactive contact means, of the preferred embodiment, engages the surface of the barrel permitting a force to be exerted between the forestock and the barrel. The threaded shaft protrudes toward the front surface of the forestock to enable it to be rotationally adjusted. The assembly also contains a shaft inadvertent rotation prevention device to apply sufficient force against the threaded shaft to allow both for desired incremental rotational adjustment of the threaded shaft, while at the same time inhibiting undesirable rotation of the shaft during discharge or handling of the rifle. The threaded shaft is secured to the assembly to prevent undesired longitudinal movement of the threaded shaft and the reactive contact means within the assembly. When the threaded shaft is rotated the reactive contact means moves longitudinally along the axis of the barrel. This motion causes a change in the longitudinal contact point of engagement of the reactive contact means and the barrel. This change of longitudinal positioning of the reactive contact means which is engaging the barrel with sufficient pressure, causes a change in the harmonic vibration characteristics of the barrel.

16 Claims, 3 Drawing Sheets

RIFLE-BARREL HARMONIC VIBRATION TUNING DEVICE

BACKGROUND—FIELD OF INVENTION

Figure 1:
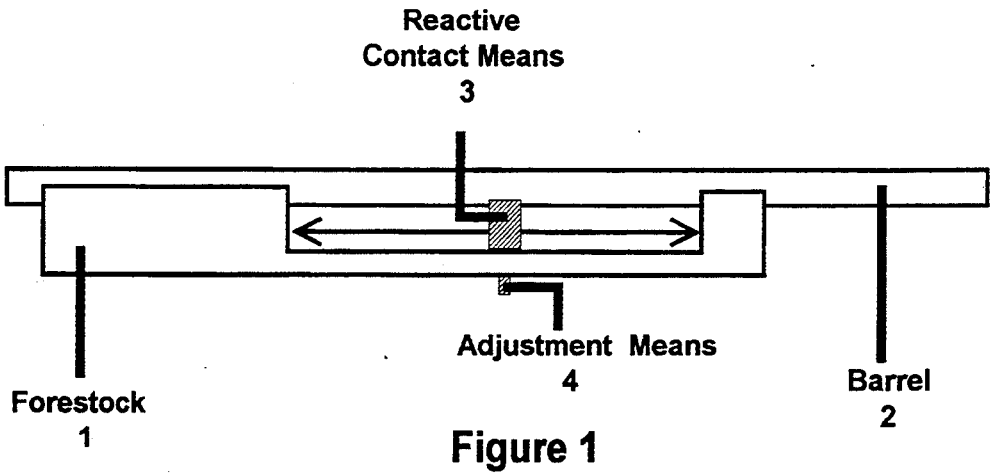

This invention relates to control of the accuracy of impact placement of a projectile fired from a rifle, specifically a device to incrementally adjust and control the harmonic vibrations of the barrel of a rifle during discharge in such manner as to allow repetitive accurate placement of a plurality of fired projectiles.

BACKGROUND—DESCRIPTION OF PRIOR ART

It has been known for years that when a rifle is discharged harmonic vibrations are set up in the barrel of the rifle. It is also known that these vibrations of the barrel prior to the projectile leaving the muzzle affect the accuracy of the aimed projectile's impact placement.

Each barrel, no matter how precisely manufactured, has its own unique vibration characteristics.

The manner in which a rifle barrel vibrates for a given ammunition loading is dependent upon an number of factors, some of which are: the physical dimensions of the barrel; whether or not the barrel contacts the forestock; and also upon the location point and the force of such contact, if any, between the barrel and forestock of the rifle.

Many attempts have been made in the past to control or dampen this vibration. Some of these have been: increasing the diameter and weight of the barrel with the barrel contacting the forestock, as is done in target rifles; rigidly fastening the barrel to the forestock as is done with military rifles; and causing the barrel to contact the forestock at some predetermined point, as is done with most sporting rifles.

Also, because of the uniqueness of each individual rifle's barrel vibration characteristics, no two rifles will have identical accuracy with the same given ammunition loading.

Another way to obtain better accuracy for a given rifle is for the rifleman to try out many different ammunition brands and loadings until a load is found that as closely as possible matches the vibration characteristics of the given rifle barrel.

This method, though very time consuming and costly, will usually allow the rifleman to find a compromise loading that will give moderately acceptable accuracy of projectile impact placement.

However, in the aforementioned method of using the selection of an ammunition loading in an attempt to match ammunition components to the barrel's unique vibration characteristics, once an acceptable loading is found, the rifleman must remain with this single ammunition selection to maintain this degree of accuracy.

Even if an acceptable ammunition loading is found, if the barrel is contacting the forestock of the rifle, as is the case with most rifles, should the relationship between the rifle's barrel and stock change due to such factors as humidity, warpage, or some other cause, then different ammunition components must be found to compensate for such changes.

Several patents are directed to providing a specific fixed support point of contact between the rifle's forestock and barrel, either with or without exerting a variable pressure against the barrel, in an attempt to simply dampen the vibration of the barrel.

Exemplary of such devices are shown in U.S. Pat. No. 2,479,594; 2,497,861; 2,589,912; 3,060,612; and 4,864,761.

All of the above mentioned Patented devices, by their design, suffer a number of obvious disadvantages.

One of which is that they all rely on the contact between such device and the barrel at a fixed non adjustable location. Another is that they only effect a change in the pressure, exerted between the device and the barrel in an attempt to dampen the barrels' vibration.

However in the operation of these devices, if a change in the adjustment in pressure to either the undersurface or side surface of the barrel is made, it also effects a change in the elevation or azimuth of the barrel's muzzle, which in turn causes an undesirable change in the impact placement of the fired projectile. Such change then necessitates that the rifleman make corresponding adjustments in the sighting device on the rifle for each change of pressure against the barrel, which is the case when using the above mentioned Patented devices.

Also some of the above mentioned Patented devices require that a hole extending through the lower surface of the forestock be made to allow for their installation. However, if the hole is not drilled in the proper location to allow for the best barrel vibration control, then another hole must be made for any subsequent change in their position with respect to the longitudinal axis of the barrel. The previously made holes then would weaken the forestock, or if filled with a substance, would then cause an undesirable appearance in the lower surface of the forestock.

With the advent of better sealant treatments for wood stocks and the increased use of stocks of man made materials such as fiberglass and other composites, the need for adjusting the change in pressure between the forestock and the side surface or undersurface of the rifle's barrel, because of changes in humidity or other environmental factors, to compensate for warpage to the rifle stock, has become much less of a problem than it was in the past.

Finally although all of the above mentioned Patented devices will dampen the barrel's vibration, the fact that they all have a barrel contact point that is fixed, only allows the devices to have a minimal affect on the control of the rifle barrel's natural harmonic vibrations.

A simple analogy to help explain why simply applying varying degrees of pressure at one point on a rifle's barrel has only minimal affect on the harmonic vibrations of the barrel, is this:

If a guitar string is made to vibrate by plucking it, it will emit a particular tone caused a by specific frequency or harmonic vibration produced in the string.

The tone or frequency of this vibration is determined by a number of factors, two of which are: at what point the string is being contacted by the fret of the guitar, and secondly, but less importantly, the amount of pressure being that is being exerted by the finger of the musician on the string against that particular fret on the guitar neck.

As long as sufficient pressure is being applied to the string against the fret, a particular harmonic vibration will be obtained. The application of additional pressure to the string, by the finger pressing it against the fret, is of small consequence in producing any further change in the harmonic vibration of the string.

If however the musician moves his finger to a different position on the guitar string and exerts sufficient pressure between the string and another fret on the guitar, a major change in the harmonic vibrations of the string is effected.

In applying the above analogy to a rifle barrel should follow then, that exerting a variable amount of pressure between a rifle stock and its barrel at a fixed position along the barrel, in an attempt to control the barrel's harmonic vibrations, will allow only one harmonic frequency to be affected, and the application of more force between the barrel and forestock than is necessary may only cause additional problems, such as an elevation in the barrel's muzzle.

This above mentioned method of simply applying a fixed position variable force between the rifle barrel and forestock, is much less effective than the method used by the present invention, which exerts instead, a sufficient amount of force between the rifle's barrel and its forestock to affect the barrel's harmonic vibration, while permitting the force to be exerted at adjustably controllable points along the barrel's length.

Each change in the longitudinal point of contact along the barrel causes a different harmonic vibration, therefore allowing this harmonic vibrational change to effect a change in the accuracy of placement of a fired projectile's impact.

OBJECTS AND ADVANTAGES

Accordingly some of the objects and advantages of my invention are:

a. To provide a user-adjustable rifle accurizing device that is mounted within the forestock of a rifle producing sufficient reactive contact between the barrel and the forestock of the rifle to effect a change in the harmonic vibrations of the barrel upon discharge, with the device having the capability of being incrementally and repeatedly adjusted to change the point of reactive contact of the device along the axis of the barrel.

b. To provide the operator of a rifle the ability to incrementally adjust the harmonic vibrations of a rifle barrel, so that during discharge, the adjustment previously having been made, will cause consistent accurate impact placement of a plurality of fired projectiles.

c. To provide a way of maintaining stationary positioning of the desired point of reactive contact between the device, the barrel and the forestock, during discharge and handling of the rifle.

d. To provide a rifle accurizing device which when mounted in the forestock is unobtrusive and easy to operate.

e. To allow a rifle's accuracy to remain consistent even when using numerous different ammunition loadings, with only a small adjustment needing to be made.

Further objects and advantages will become apparent from a consideration of the ensuing description and drawings.

DRAWING FIGURES

FIG. 1 is a graphical representation of a basic form of the present invention shown mounted in the forestock of a rifle.

FIG. 2

Is a top view of graphical representation of the basic form of the present invention shown mounted in the forestock of a rifle with the barrel removed.

FIG. 3

Is a graphical representation a cutaway front view of a basic form of the of the present invention.

FIG. 4

Is a cutaway side view of the preferred embodiment of the present invention.

Figure 5:
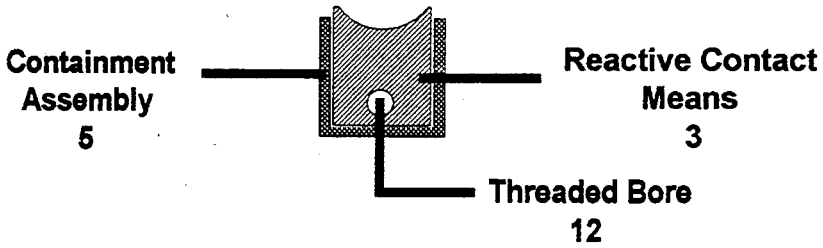
Figure 6:
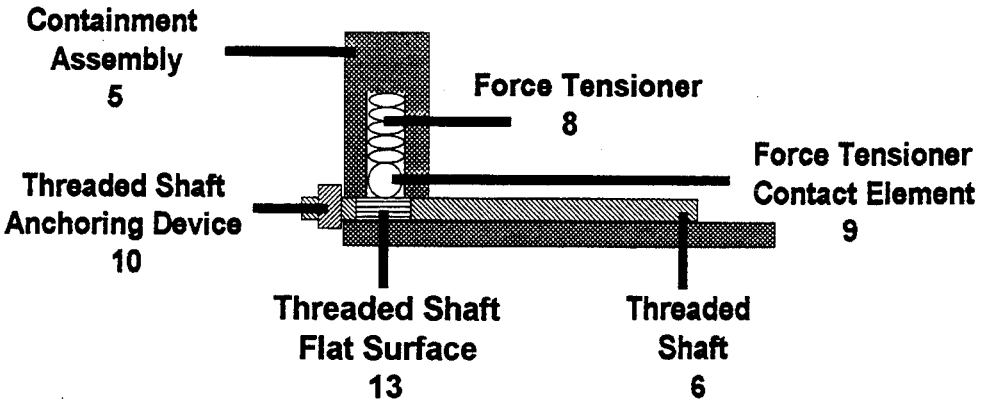
Figure 7:
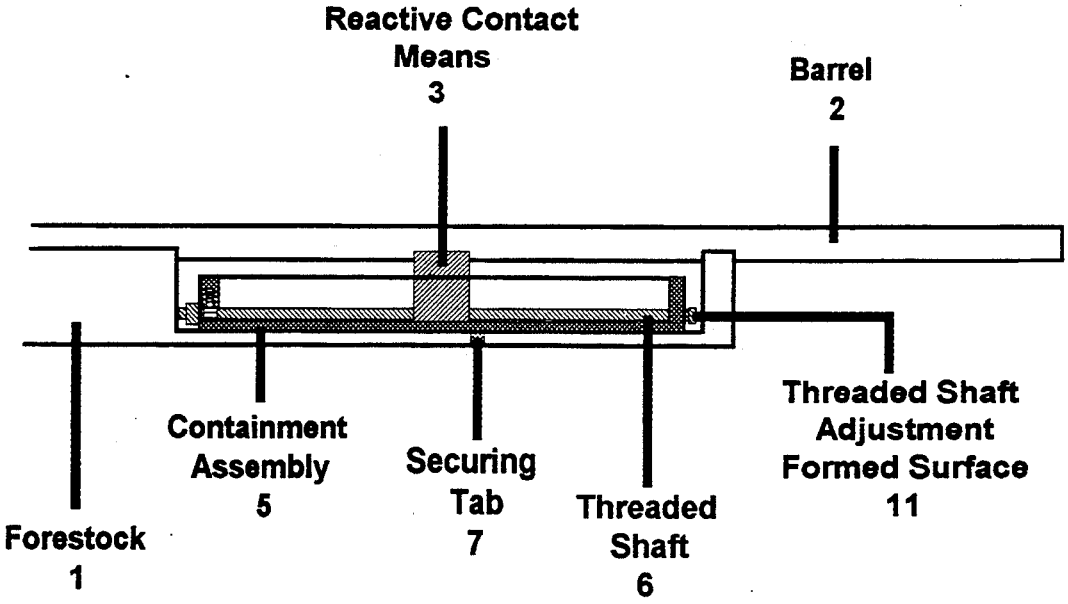

FIG. 5 Is a cutaway front view showing the reactive contact means and containment assembly of the preferred embodiment of the preferred invention.

FIG. 6

Is a cutaway side view of the rear portion of the containment assembly of the preferred embodiment, enlarged to enhance display of contained operational elements.

FIG. 7 is a graphical representation of the preferred embodiment of the present invention as it would appear mounted in a rifle forestock.

REFERENCE NUMERALS IN DRAWINGS

1. Forestock
2. Barrel
3. Reactive Contact Means
4. Adjustment Means
5. Containment Assembly
6.Threaded Shaft
7. Securing Tab
8. Force Tensioner
9. Force Tensioner Contact Element
10. Threaded Shaft Anchoring Device
11. Threaded Shaft Adjustment Formed Surface
12. Threaded Bore
13. Threaded Shaft Flat Surface

DESCRIPTION—FIGS. 1-7

FIG. 1

Is a cutaway side view showing the relationship of the Forestock 1, and the Barrel 2, to a Reactive Contact Means 3, with the Adjustment Means 4 being an extension of Reactive Contact Means 3 protruding through the undersurface of the Forestock 1, with a directional arrow indicating the direction of movement of Reactive Contact Means 3 along the axis of Barrel 2.

FIG. 2

Is a top view of the Forestock 1 with Barrel 2 being removed, further showing the relationship of a Reactive Contact Means 3 to the Forestock 1 with a directional arrow indicating the direction of movement of the Reactive Contact Means 3 along the axis of Barrel 2.

FIG. 3

Is a cutaway front view further showing the relationship of the Forestock 1, and the Barrel 2, to a Reactive Contact Means 3, and its extension Adjustment Means 4, shown protruding through the undersurface of Forestock 1.

FIG. 4

Is a cutaway side view of the present invention showing the Containment Assembly 5, the Reactive Contact Means 3, the Threaded Shaft 6, the Threaded Shaft Adjustment Formed Surface 11, the Securing Tab 7, and the Threaded Shaft Anchoring Device 10.

FIG. 5

Is a cutaway front view of the present invention showing Containment Assembly 5, Reactive Contact Means 3, with Threaded Shaft 6 being removed, to show the Threaded Bore 12 of Reactive Contact Means 3.

FIG. 6

Is a cutaway partial side view of Containment Assembly 5, showing a method of providing tension against the Threaded Shaft 6, as used in the preferred embodiment of the present invention comprising a Force Tensioner 8, being a spring, a Force Tensioner Contact Element 9, being a steel sphere, a Threaded Shaft Anchoring Device 10, for preventing longitudinal movement of Threaded Shaft 6 and a Threaded Shaft Flat Surface 13.

FIG. 7

Is a cutaway side view of Forestock 1 wherein is mounted Containment Assembly 5, containing Reactive Contact Means 3 engaging the surface of Barrel 2, which is threadedly mated with Threaded Shaft 6, which has a Threaded Shaft Adjustment Formed Surface 11. Securing Tab 7, is shown extending to the lower surface of Forestock 1, whereby a rifle sling attachment can be affixed.

OPERATION FIGS. 1–7

FIG. 1

A adequately sized cavity is formed within Forestock 1 to both receive the Reactive Contact Means 3 and to allow for sufficient longitudinal travel along the axis of the Barrel 2, to allow the desired positioning of Reactive Contact Means 3 with respect to Barrel 2.

Reactive Contact Means 3 engages the undersurface of Barrel 2, while at the same time engaging the lower surface of the cavity formed in Forestock 1, causing a force to be exerted between Forestock 1 and Barrel 2.

Adjustment Means 4, is an extension of the Reactive Contact Means 3, which is protruding through a narrow opening in the undersurface of Forestock 1.

If a rifleman wishes to change the point of engagement of the Reactive Contact Means 3, with Barrel 2, he or she applies force against the Adjustment Means 4 to move it forward or backward along the axis of the Barrel 2.

The Reactive Contact Means 3, could be constructed of numerous components and be made of many different types of materials, preferably however, it would be made of a material that would not cause damage to the surface of Barrel 2.

FIG. 2

Figure 2:
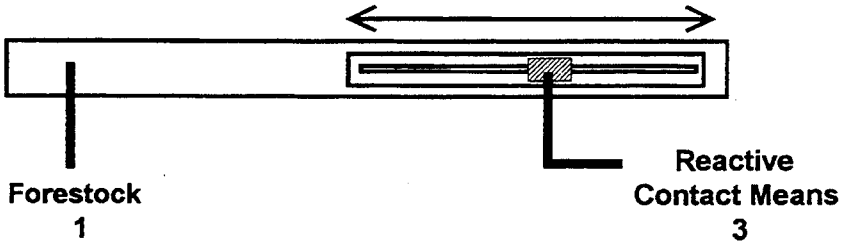
Figure 3:
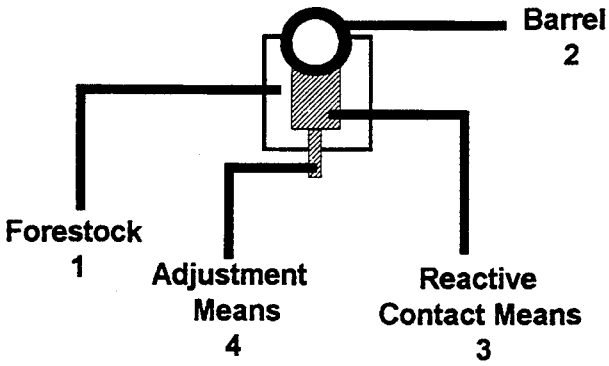

Is a top view of a basic form of the present invention with the barrel being removed. The operation of Reactive Contact Means 3 is the same as described in FIG. 2.

FIG. 3

Is a cutaway front view of a basic form of the present invention showing the relationship of Reactive Contact Means 3 to the Forestock 1, and the Barrel 2. The operation of Reactive Contact Means 3 is the same as described in FIG. 2.

FIG. 4

Is a cutaway side view of the Harmonic Tuning Device.

Containment Assembly 5 is of sufficient material and dimension to support the operational elements of the present invention. It is a rectangular receptacle with an opening in the top having two side surfaces and two end surfaces. The two end surfaces each having a non threaded hole formed in it to receive the Threaded Shaft 6. It also has a lower surface having a threaded Securing Tab 7, formed in the exterior of the lower surface.

Securing Tab 7 which is internally threaded, protrudes downwardly through the rifle forestock for the purpose of securing the Containment Assembly 5 to the forestock, permitting a sling attachment device to be threaded into Securing Tab 7 and then tightened to a sufficient force to prevent unwanted movement of the Containment Assembly 5, within the forestock.

Threaded Shaft 6, is threadedly mated with Reactive Contact Means 3.

Threaded Shaft 6 has a formed surface at its end which allows a user to either grasp the surface or if preferred use a tool such as a screw driver, Allen type wrench or socket type wrench to rotate Threaded Shaft 6.

When Shaft 6 is rotated, Reactive Contact Means 3 travels longitudinally between the two ends of the Containment Assembly 5.

FIG. 5

Figure 4:
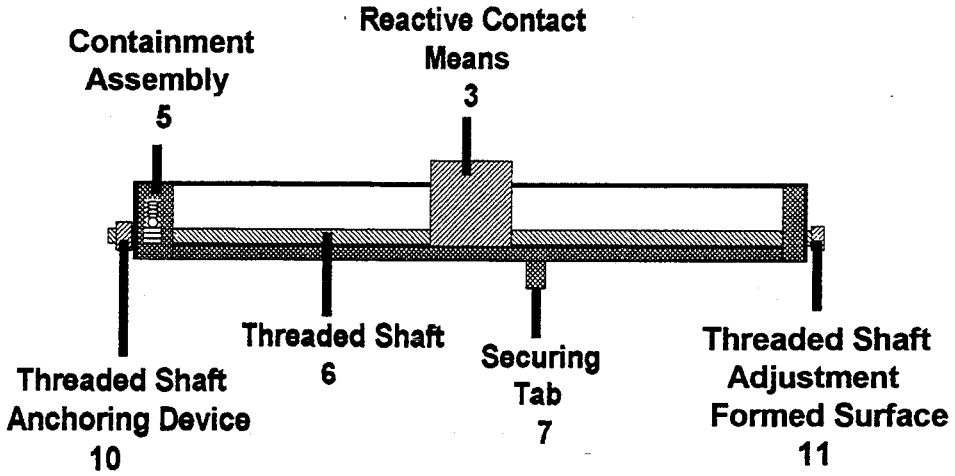

Is a graphical representation of a cutaway front view of the preferred embodiment of the present invention showing the Containment Assembly 5, and the Reactive Contact Means 3 wherein resides Threaded Bore 12 which threadedly mates with Threaded Shaft 6. The operation of Reactive Contact Means 3 is the same as described in FIG. 4.

FIG. 6

Is an enlarged cutaway view of one end portion of Containment Assembly 5 showing a method of applying force to Threaded Shaft 6 to allow incremental adjustment and positive positioning of Threaded Shaft 6.

Threaded Shaft 6 is anchored in place by Shaft Anchoring Device 10 to prevent it from moving longitudinally within Containment Assembly 5.

Because of the fact, that once an adjustment of Threaded Shaft 6 is made, it is desirable to have the shaft remain in its last adjustment position, Force Tensioner 8 is contained within Containment Assembly 5 to effect this desired result.

Threaded Shaft Flat Surface 13 is formed on Threaded Shaft 6 in the proper position to engage Force Tensioner Contact Element 9, which is in contact with Force Tensioner 8 which is compressed when installed into Containment Assembly 5. One or more of these flat surfaces may be formed on Threaded Shaft 6 to allow for the desired increments of adjustment.

The aforementioned flat surface or surfaces, allow for positive incremental rotational adjustments of Threaded Shaft 6. The Force Tensioner 8 also supplies sufficient pressure against Threaded Shaft 6 to prevent inadvertent rotational movement during rifle handling or discharge.

FIG. 7

Is a graphical representation of a preferred embodiment of the present invention as it might be installed in a rifle forestock.

A cavity of proper dimension is formed within Forestock 1 to receive the present invention, with the forward end of Forestock 1 having a longitudinal bore formed therein to accommodate the insertion of an adjustment tool to rotate Threaded Shaft 6.

The undersurface of Containment Assembly 5 rests upon the floor of the aforementioned formed cavity with Securing Tab 7 extending downward within the lower surface of Forestock 1.

When the rifle action is properly affixed to the rifle stock, Barrel 2 makes contact with Reactive Contact Means 3.

Because Reactive Contact Means 3 is engaging the floor of Containment Assembly 5, which is engaging the floor of the aforementioned cavity of Forestock 1, a force is exerted between the Barrel 2 and Forestock 1.

When Threaded Shaft 6 is rotated it causes Reactive Contact Means 3 to travel in a desired direction along the axis of Barrel 2.

With a force being exerted between the Reactive Contact Means 3 and Barrel 2 this aforementioned change in longitudinal position effects a change in the harmonic vibration characteristics of Barrel 2.

SUMMARY SCOPE AND RAMIFICATIONS

Accordingly, the reader will see that the rifle-barrel harmonic vibration tuning device of this invention precisely controls the accurate placement of a plurality of fired projectiles from a rifle. The device is easy to operate with the rifle user having only to rotate a shaft to cause a change in the harmonic vibration characteristics of the barrel thus controlling the projectile's impact placement. Also once a desired adjustment is made it will remain in its adjusted position until the user wishes to change it. In addition if a user wishes to change ammunition components he or she can simply change the adjustment of the device which will cause a desired change the harmonic vibration of the barrel to match the ammunition being used, thereby controlling the projectile's impact placement.

Furthermore the rifle barrel harmonic vibration tuning device has the additional advantages in that:

- it is mounted in the forearm of the rifle stock, therefore being out of sight, thus causing only a slight change in the outward appearance of the rifle.
- it has the advantage of being able to be fitted to a newly manufactured rifle or of being easily installed in a pre-existing rifle
- it eliminates the need of the user being limited to one particular ammunition loading or brand, in order to obtain consistent fired projectile accuracy.
- it allows precise repetitive repositioning of the reactive contact means in relation to the axis of the barrel.
- it could contain an easily removable reactive contact means that can be replace if necessary to compensate for wear that may be caused by barrel contact with it, or for changes in the dimensional relationship between the forestock and the barrel, which may be caused by changes in humidity or other environmental factors.
- it allows the elevational point of impact of a fired projectile to remain consistent with the previously fired projectile even after adjustment.
- it allows a repetitive range of adjustment, to allow a minimum grouping of the impact points of a plurality of fired projectiles, without the necessity of a change in the sighting apparatus of the rifle.

Although the description above contains many specificity's, these should not be construed as limiting the scope of the invention but as merely providing illustrations of some of the presently preferred embodiments of this invention. For example, the reactive contact means could be of magnetic properties, or have a notch in the upper surface that engages the barrel, the inadvertent shaft rotation prevention device could be a pressure washer, the harmonic vibration tuning device could be affixed to the cavity of the stock by anchoring elements at some point along the threaded shaft, rather than using a containment assembly, etc.

Thus the scope of the invention should be determined by the appended claims and their legal equivalents, rather than by the examples given.

I claim:

1. In a rifle having a rifle action with a cantilevered barrel for directing a projectile along the barrel axis and extending forwardly of the rifle action; said barrel being substantially unconnected with respect to a stock forearm that extends forwardly beneath the barrel; said stock forearm having an elongated stock body with a lower profile surface enabling a rifleman to grip and point the rifle and an upper profile surface having a longitudinal groove formed therein for receiving the barrel therein without the barrel engaging the entire upper profile surface; a harmonic vibration tuning device mounted in the stock forearm and spaced forwardly of the rifle action; said harmonic vibration tuning device comprising:

a reactive force application means in combination with a longitudinal position adjustment means incorporated in such a manner as to provide for repetitive precise longitudinal positioning of said reactive force application means to a desired location along the axis of the barrel and the stock forearm, while exerting a force between the stock forearm and barrel, with said force effecting change in harmonic vibrations of the barrel as a projectile travels through the barrel.

2. In the rifle according to claim 1 wherein said reactive force application means is a reactive contact means.

3. In the rifle according to claim 2 wherein said reactive contact means is of sufficient dimension to allow physical contact between the surface of said barrel and said stock forearm when said rifle action is affixed to said stock body.

4. In the rifle according to claim 1 wherein said reactive force application means is a magnet.

5. In the rifle according to claim 2 wherein the harmonic vibration tuning device further comprises a containment assembly of sufficient dimensions to provide support and containment of the reactive contact means and additional operational elements of the harmonic vibration tuning device.

6. In the rifle according to claim 5 wherein said additional operational elements comprise a threaded shaft; a shaft anchoring device; and a shaft inadvertent rotation prevention device.

7. In the rifle according to claim 6 wherein said reactive contact means has a threaded longitudinal bore of adequate dimensions formed therein to threadedly mate with said threaded shaft.

8. In the rifle according to claim 2 wherein said reactive contact means is a nylon block.

9. In the rifle according to claim 6 wherein said threaded shaft has an adequately formed surface at one of its ends to allow mating with an adjustment tool, and being of sufficient length to permit desired motion and longitudinal positioning of said reactive contact means along the axis of said barrel.

10. In the rifle according to claim 6 wherein the shaft anchoring device comprises an element of sufficient dimension to secure said threaded shaft in such a manner so as to prevent undesirable longitudinal movement of the threaded shaft within the containment assembly.

11. In the rifle according to claim 6 wherein said shaft inadvertent rotation prevention device inhibits undesirable rotational motion of said threaded shaft during handling or discharge of the rifle; said shaft inadvertent rotation prevention device comprising a force tensioner element; and a force tensioner contact element.

12. In the rifle according to claim 11 wherein said force tensioner element is a spring.

13. In the rifle according to claim 12 wherein said force tensioner contact element is a steel sphere.

14. In the rifle according to claim 13 wherein said spring is installed in such a manner so as to exert a force upon said steel sphere.

15. In the rifle according to claim 13 wherein said threaded shaft has a flat surface formed thereon to engage said steel sphere in such a manner so as to prevent undesired rotational motion of the threaded shaft.

16. In the rifle according to claim 5 wherein said containment assembly has an undersurface with a downwardly extending internally threaded securing tab formed thereon, and of sufficient dimensions to threadedly mate with a rifle sling attachment device for permitting secure attachment of the containment assembly to the stock forearm.

* * * * *

UNITED STATES PATENT AND TRADEMARK OFFICE

CERTIFICATE OF CORRECTION

PATENT NO. : 5,423,145
DATED : June 13, 1995
INVENTOR(S) : James L. Nasset

It is certified that error appears in the above-identified patent and that said Letters Patent is hereby corrected as shown below:

Title page,
Item [57], ABSTRACT,
Line 2, remove the word "forestock" and replace with -- forend --

Column 3,
Line 35, remove "within the forestock of a rifle" and replace with -- forward of a rifle action or receiver --;
Line 37, remove "of the rifle" and replace with -- or an attached mounting fixture --;
Line 54, remove "in the forestock" and replace with -- forward of the action or receiver --

Column 7,
Line 31, remove the word "is" and replace with -- could be --;
Line 65, add -- or knob -- after the word "washer";
Line 66 remove the word "to" and replace with the word -- in --;
Line 68, after the word "assembly" add a -- period --;
Line 68, after the added period, add -- It could be mounted to a fixture or a mounting assembly attached to the receiver or action or part etc, to provide the necessary pressure against the rifle barrel to effect attenuation. --

Signed and Sealed this

Twenty-fifth Day of November, 2003

JAMES E. ROGAN
*Director of the United States Patent and Trademark Office*